US006845284B2

(12) United States Patent
Bingham et al.

(10) Patent No.: US 6,845,284 B2
(45) Date of Patent: Jan. 18, 2005

(54) METHODS AND SYSTEMS FOR DESIGNING CIRCULARLY KNITTED GARMENTS

(75) Inventors: Geoffrey Bingham, Sibso (GB); David Bruner, Cary, NC (US); Jeffery Hurley, Cary, NC (US)

(73) Assignee: Sara Lee Corporation, Winstom-Salem, NC (US)

( * ) Notice: Subject to any disclaimer, the term of this patent is extended or adjusted under 35 U.S.C. 154(b) by 24 days.

(21) Appl. No.: 10/364,682

(22) Filed: Feb. 11, 2003

(65) Prior Publication Data

US 2004/0176869 A1 Sep. 9, 2004

(51) Int. Cl.[7] ..... G06F 19/00
(52) U.S. Cl. ..... 700/141; 700/130; 700/132; 66/8
(58) Field of Search ..... 700/141, 97, 98, 700/130, 131; 66/232, 237

(56) References Cited

U.S. PATENT DOCUMENTS 4,527,402 A * 7/1985 Swallow et al. ..... 66/55
4,856,104 A * 8/1989 Stoll et al. ..... 700/141
5,222,379 A * 6/1993 Rikiishi et al. ..... 66/30
5,388,050 A * 2/1995 Inoue et al. ..... 700/131
5,557,527 A * 9/1996 Kotaki et al. ..... 700/131

* cited by examiner

*Primary Examiner*—John Calvert
*Assistant Examiner*—Brian Kauffman
(74) *Attorney, Agent, or Firm*—Ohlandt, Greeley, Ruggiero & Perle, L.L.P.

(57) ABSTRACT

A method and system for designing circularly knitted garments are provided. The method includes designing a model of the circularly knitted garment, stretching the model from a first size to a second size, and governing the stretching with one or more user definable rules. The system includes a circular knitting machine, a controller for controlling the circular knitting machine with a machine code, a tool for saving a model of the circularly knitted garment as a first output, and a conversion program for converting the first output into the machine code. The tool has a stretching function for changing a size of the first output using one or more user selected rules.

11 Claims, 6 Drawing Sheets

FIGURE 2
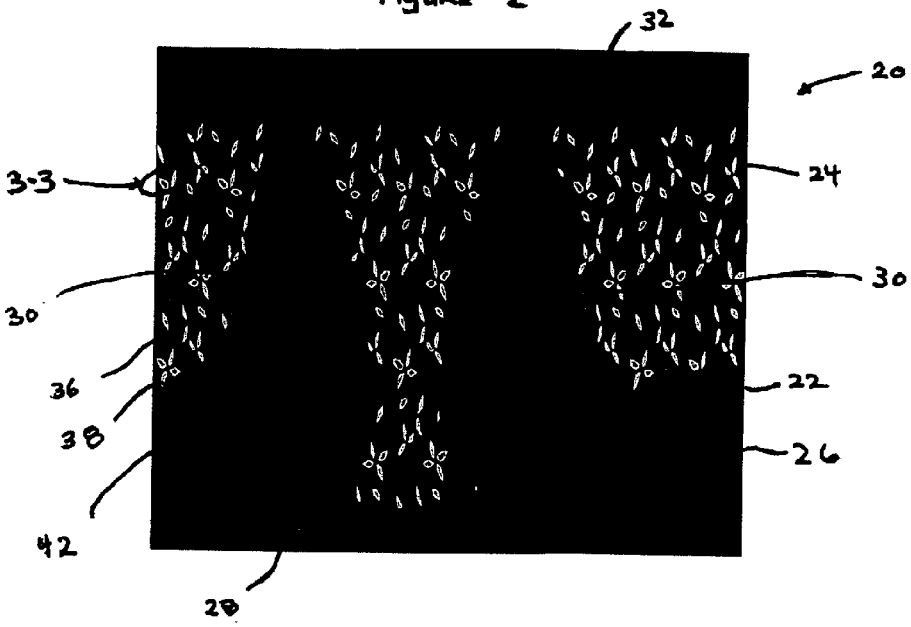
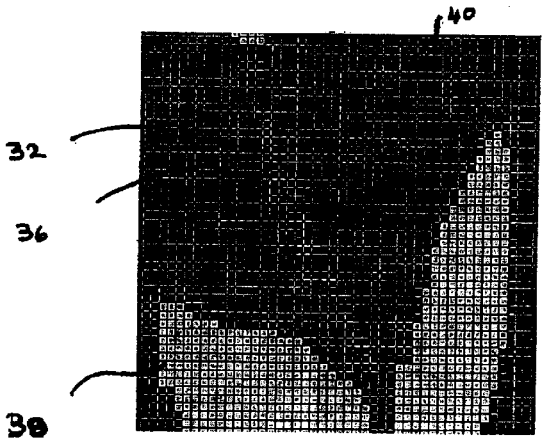
FIGURE 4
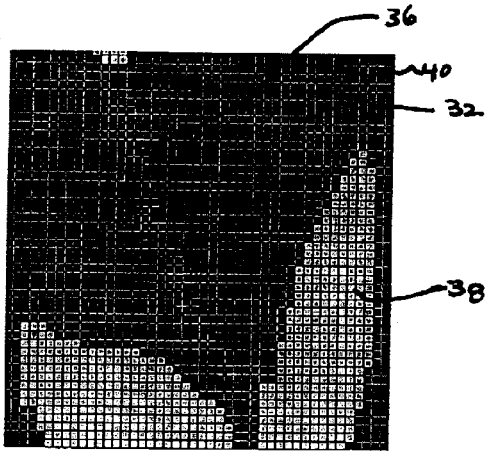
FIGURE 3

METHODS AND SYSTEMS FOR DESIGNING CIRCULARLY KNITTED GARMENTS

BACKGROUND OF THE INVENTION

1. Field of the Invention

The present invention is related to circularly knitted garments. More particularly, the present invention relates to methods and systems for designing circularly knitted garments.

2. Description of Related Art

Circular knitting processes, such as described in commonly owned and assigned U.S. Pat. No. 6,178,781 to Myers, have found wide use in the production of seamless tubular garment blanks. Such seamless tubular garment blanks can be used in the production of a variety of clothing items, such as pantyhose, panties, stockings, brassieres, halter type blouses, figure persuasive underwear, and the like.

It is generally desired for the circularly knitted garments to be provided in a range of sizes that can meet the range of consumer body types, structures, and sizes. In addition, it is also often desired for the circularly knitted garments to include decorative patterns knitted into the garment.

The machines for circularly knitting such garments can be very complex. These machines are controlled by a program or code that must be entered into the machine. The conversion of a garment into this machine code can be very time consuming. This time consuming process is made even greater by the fact that it must be completed for each size of a particular garment. For example, there can be upwards of twelve different sizes for some garments. In this example, the process of converting the garment into the machine code must be repeated for each of the twelve sizes.

Accordingly, continued improvements in the methods of designing circularly knitted garments are desired.

SUMMARY OF THE INVENTION

It is an object of the present invention to provide a method of designing circularly knitted garments.

It is another object to provide a method of designing circularly knitted garments that allows for the designed garment to be easily scaled to a variety of sizes.

It is still another object of the present invention to provide a method that allows for circularly knitted garments to be designed in three-dimensions.

It is yet another object of the present invention to provide a method that allows for circularly knitted garments to be saved as object oriented outputs so that the relationships between the attributes of the garment can easily be modified.

These and other objects and advantages of the present invention are provided by a method of designing a circularly knitted garment that includes designing a model of the circularly knitted garment, stretching the model from a first size to a second size, and governing the stretching with one or more user definable rules.

The present invention also provides a method of designing a circularly knitted garment that includes designing a three-dimensional model of the circularly knitted garment and saving the three-dimensional model as a first output and/or a second output. The first output is a two-dimensional bitmap file and the second output is a related object file. In at least one embodiment, this method also includes stretching the first output from a first size to a second size and governing the stretching with one or more user definable rules.

The present invention further provides a method of designing a circularly knitted garment that includes modeling the circularly knitted garment as a first output and changing the first output from a first size to a second size by restricting at least one attribute of the first output.

The present invention also provides a system for designing and manufacturing a circularly knitted garment. The system includes a circular knitting machine, a controller for controlling the circular knitting machine with a machine code, a tool for saving a model of the circularly knitted garment as a first output, and a conversion program for converting the first output into the machine code. The tool has a stretching function for changing a size of the first output. The stretching function changes the size using one or more user selected rules.

The above-described objects, as well as other features and advantages of the present invention, will be appreciated and understood by those skilled in the art from the following detailed description, drawings, and appended claims.

BRIEF DESCRIPTION OF THE DRAWINGS

FIG. 2 illustrates a two-dimensional model generated by the system of FIG. 1;

FIG. 3 is a view of circle 3—3 of the model of FIG. 2;

FIG. 4 illustrates is first type of scaling error induced by the system of FIG. 1;

DETAILED DESCRIPTION OF THE INVENTION

Figure 1:
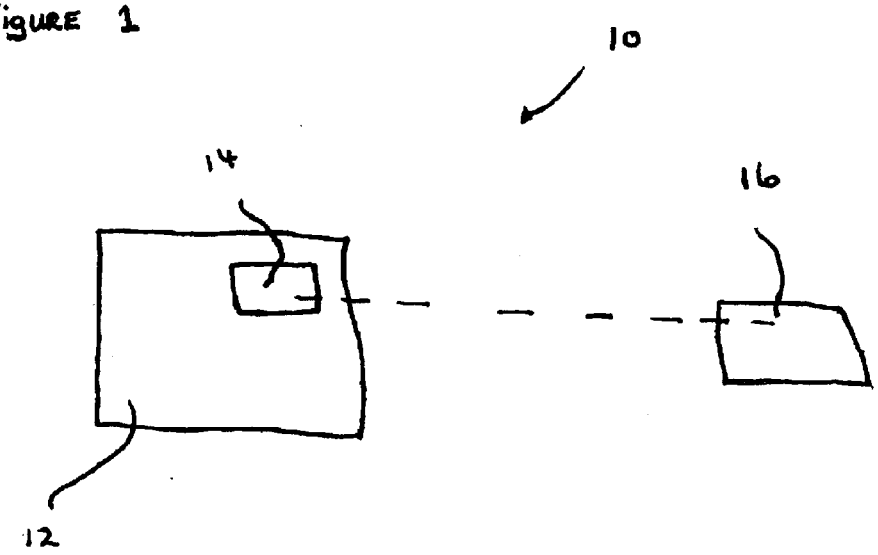
FIG. 1 is a schematic depiction of a prior art circular knitting system.

Referring to the drawings and in particular to FIG. 1, a prior art circular knitting system is generally referred to by reference numeral 10. System 10 has a knitting machine 12 that is controlled by a computer program or code that is resident on a controller 14. Controller 14 is in electrical communication with a design and conversion program 16.

By way of example only, system 10 can be a Santoni knitting system where machine 12 is a Santoni SM8 machine and program 16 is a Dinema™ software package.

Program 16 allows the user to design the desired garment as a two-dimensional graphic model 20 illustrated in FIG. 2. For example, program 16 can allow the user to model the desired garment in a common paint program, such as Microsoft's Paint program, and save the design as a bitmap image. Program 16 then converts the bitmap image of model 20 into the machine code necessary for controller 14 to operate machine 12 to produce the desired garment. Thus, program 16 is used for designing a garment as a bitmap file, and converting that bitmap file into the necessary machine code.

However, it has been found that program 16 has limited utility in designing garments. Examples of some deficiencies encountered when designing garments on program 16 are illustrated with reference to FIGS. 2 through 4.

Program 16 can be used to provide a two-dimensional model 20 of a tubular blank (not shown) to be knitted by machine 12. Model 20 represents the tubular blank laid out along its circumference.

Model 20 has a cut line 22, which defines the line of separation between a garment portion 24 and a scrap portion 26. For purposes of clarity only, garment portion 24 is described herein as a woman's panty. Of course, it is contemplated by the present invention for garment portion 24 to be any circularly knitted item, such as pantyhose, tights, stockings, socks, men's underwear, brassiere, halter-type blouse, bathing suit, medical brace, and similar garment apparel.

Cut line 22 defines a center panel 28, a pair of leg holes 30, and a body-encircling portion 32. Garment portion 24 is illustrated having a decorative pattern 34 knitted therein. Decorative pattern 34, best illustrated in FIG. 3, is a flowered pattern having a number or plurality of intertwined vines 36 and leaves 38.

In program 16, each stitch of model 20 is represented as a different pixel 40 as shown in FIG. 3. Program 16 represents each stitch type as a different color pixel 40. In addition, program 16 represents each pixel 40 as a uniform size. Once model 20 is completed, the conversion function of program 16 is used to convert model 20 into the machine code, which is input into controller 14 for operating machine 12.

It has been determined that approximating pixels 40 as a uniform size limits the utility of program 16 in the design of garments. In reality, different stitch types have different sizes. Thus, it can be difficult for the designer to visually see the effects introduced into the garment due to selecting different stitch types when using program 16. Accordingly, this uniform approximation limits the utility of program 16 as a design tool.

It has also been determined that program 16 has limited utility when attempting to scale model 20 to design garments of varied sizes. Program 16 scales the aspects of model 20 the same amount. This can induce one or more types of scaling error in the scaled model, which can lead to defects in the resultant garment. The scaling errors induced by program 16 also limit its usefulness in the design of garments.

A first example of the scaling error that can be caused by program 16 is illustrated with reference to FIGS. 3 and 4. FIG. 3 illustrates decorative pattern 34 prior to scaling by program 16, while FIG. 4 illustrates decorative pattern 34 after being scaled to a larger size by program 16. Prior to scaling, vine 36 has a maximum width of three pixels 40. However after scaling, certain regions of vine 36 have a width of four pixels 40.

This first type of scaling error can create problems in the resultant tubular blank both structurally and aesthetically. For example, the stitch structure of vine 36 can be weaker than other regions of garment portion 24. Thus, it may be structurally undesirable to have four pixels 40 (i.e., stitches) of this type in a row. In addition, it can be aesthetically unpleasing to have decorative pattern 34 with vine 36 having a width greater than three pixels 40 (i.e., stitches). Accordingly, garments designed and scaled using program 16 must often be manually fixed, pixel by pixel, to remove these and other affects of this first type of scaling error.

In addition to this first type of scaling error, program 16 can also induce a second type of scaling error. Again, program 16 scales all aspects of model 20 the same amount. However, it is not always desirable to scale all aspects of model 20 the same amount.

For example, scaling model 20 from one size to another size may require a first increase in the size of body-encircling portion 32, but a second, smaller increase in the size of leg holes 30. Additionally, it can be desirable to change the shape of leg holes 30 as the garment is scaled. In order to alter model 20 to accommodate either of the above changes, cut line 22 would need to be moved. However, program 16 creates model 20 as a bitmap image. Thus, altering model 20 in program 16 requires cut line 22 to be erased and redrawn as a second cut line 42 as shown in phantom in FIG. 2.

In addition to erasing cut line 22 and drawing cut line 42, model 20 would also require further processing in program 16 to include additional decorative pattern 34 in the new areas of the model added by the second cut line. Accordingly, garments designed and scaled using program 16 must also be manually fixed to remove the affects of this second type of scaling error.

For these and other reasons, program 16 has proven less than optimal in rapidly designing garments of various sizes. Namely, it has proven very difficult to design the desired garments with program 16 without a trial and error iteration process, which requires model 20 to be updated and samples to be manufactured until the desired garment is achieved. However, program 16 has proven to be a simple and reliable method of converting model 20 (e.g., two dimensional bitmap files) into the necessary machine code.

Figure 5:
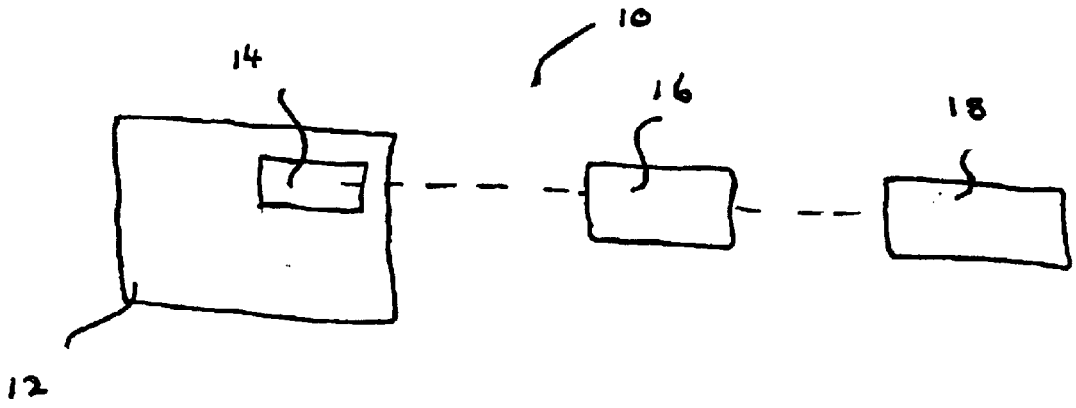
PRIOR ART FIGURE 5
FIG. 5 is a schematic depiction of an exemplary embodiment of a design tool according to the present invention in use with the system of FIG. 1.

Now, it has been determined that the speed and accuracy of designing garments, and scaling of these garments into multiple sizes, can be improved through the use of a design tool 18. As illustrated in FIG. 5, tool 18 is in electrical communication with program 16. Tool 18 addresses one or more of the aforementioned deficiencies and drawbacks of using the design function of program 16, while taking advantage of the converting function of the program.

The operation of design tool 18 is described with reference to FIG. 6. Tool 18 allows the user to create a three-dimensional model 44 of the garment in which each stitch type is represented as a different color. By allowing the user to design the garment in three dimensions instead of two, tool 18 increases the accuracy as compared to prior systems.

Tool 18 can save model 44 as first output 46. First output 46 is, preferably, a two-dimensional bitmap output that can be input into program 16 for conversion into the machine code necessary for controller 14 to operate machine 12.

Figure 7:
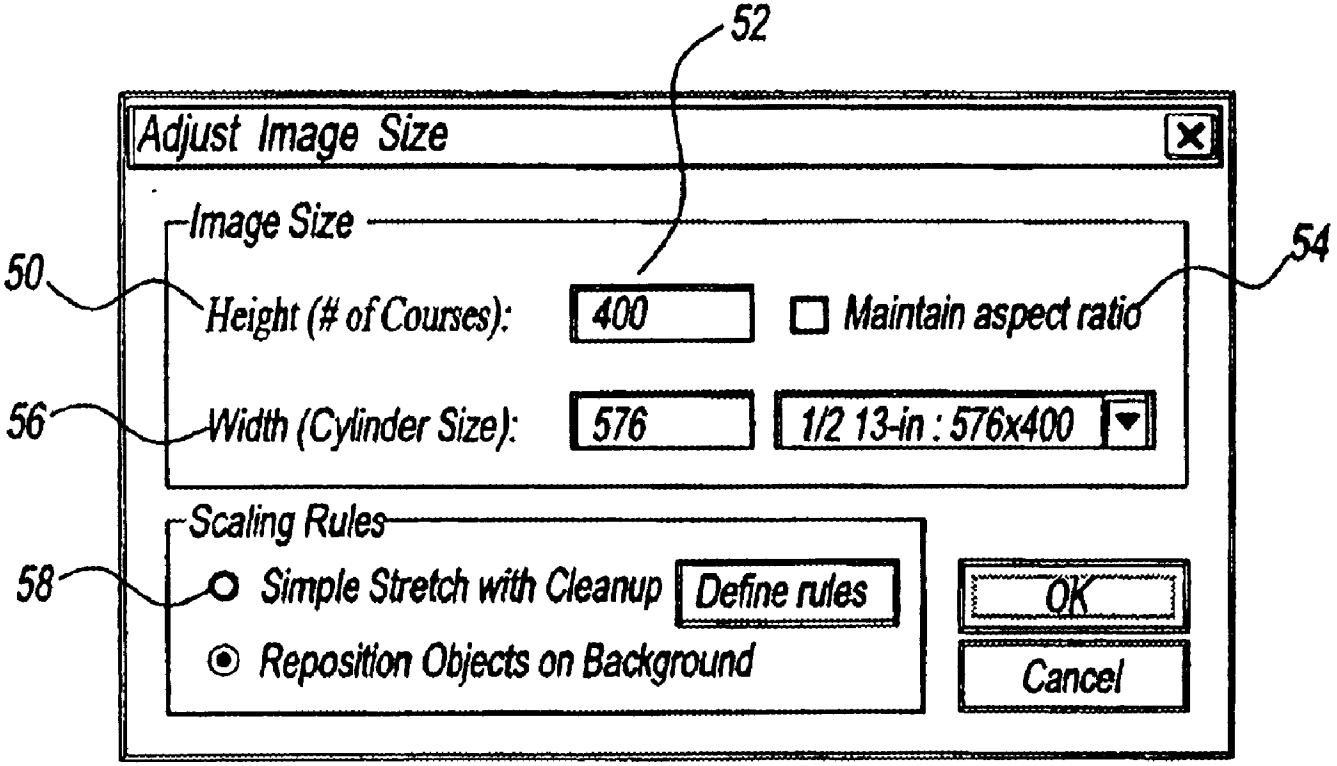
FIG. 7 illustrates a first aspect of a stretching function of the design tool of FIG. 5.
Figure 8:
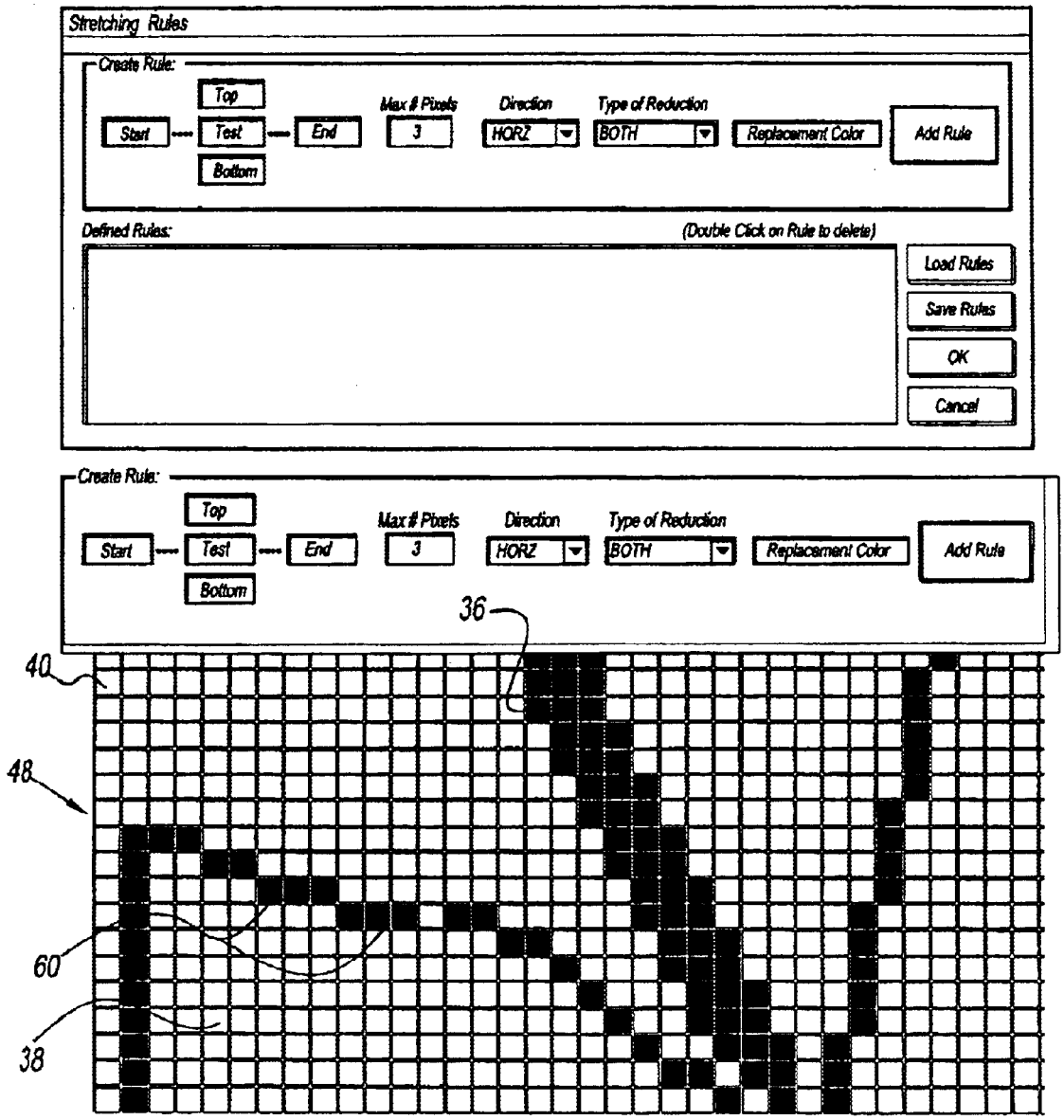
FIG. 8 illustrates a second aspect the stretching function.

In addition to allowing three-dimensional design, tool 18 has a stretching function 48 for stretching the design to one or more desired sizes. As illustrated in FIGS. 7 and 8, stretching function 48 allows the user to stretch first output 46 by defining a height 50 as a function of the number of courses 52 in model 44. Height 50 can be stretched while maintaining an aspect ratio 54 between the height and a width 56. Alternately, first output 46 can be stretched by defining both height 50 and width 56 independent of one another. It is also contemplated for width 56 to be stretched while maintaining aspect ratio 54 between height 50 and the width.

Further, stretching function 48 of tool 18 can be used to govern the stretching of first output 46 using one or more user definable rules 58. In the example given above, scaling of model 20 with program 16 resulted in the first type of scaling error where vine 36 undesirably grew in width from three pixels 40 to four pixels. Advantageously, stretching function 48 allows the user to govern the stretching of first output 46 with one or more user selected rules that eliminate this undesired scaling error.

As illustrated in FIG. 8, first output 46 is stretched with a rule 58 that limits the maximum number of pixels 40 of a particular type (i.e., the type used in vine 36). Rule 58 limits the maximum number of pixels 40 of the type used in vine 36 to no more than a desired number of stitches in a desired direction, such as no more than three stitches a horizontal direction. This rule 58 also allows the user to instruct tool 18 to replace stitches in excess of three with a desired stitch type.

It can also be seen in FIG. 8 that leaves 38 have an outline 60, which has the same stitch type as vine 36. Rule 58 can also be limited to only those instances where the stitch type of pixel 40 is not bounded on either side by the stitch type of leave 38. Thus, rule 58 can be tailored by the user to stretch first output 46 in the desired manner.

It should be recognized that tool 18 is illustrated above by way of example only as having only one rule 58. Of course, it is contemplated for tool 18 to use as many rules 58 as necessary to stretch first output 46 to achieve the desired garment. In this manner, tool 18 can restrict the stretching of only some aspects or particular stitch types of first output 46. The user can define rule 58 to selectively restrict the stretching of various aspects of first output 46 for aesthetic reasons, structural reasons, or both.

It should also be recognized that stretching function 48 can stretch first output 48 from a larger size to a smaller size (i.e., a reduction in size) and can stretch the first output from a smaller size to a larger size (i.e., an increase in size).

Figure 6:
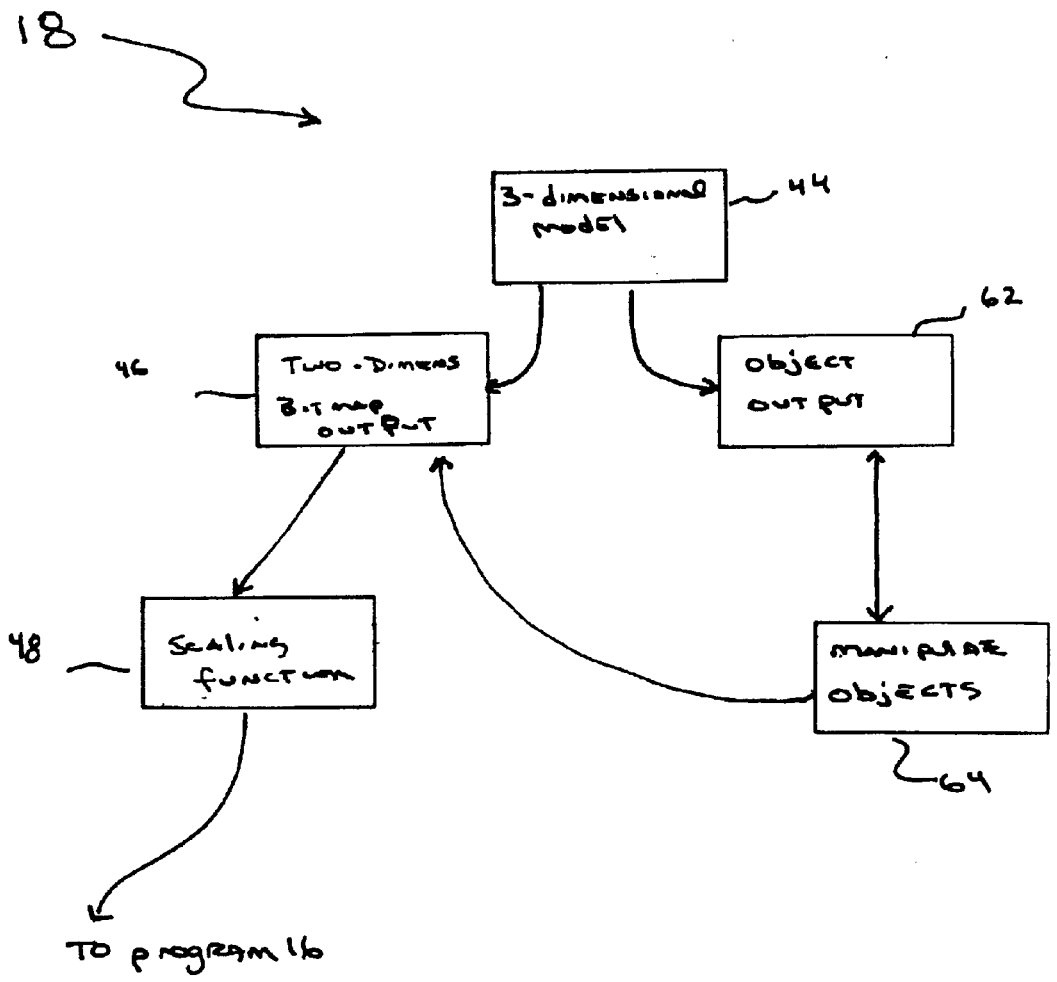
FIG. 6 is a block diagram of the design tool of FIG. 5.

In addition to saving model 44 as first output 46, tool 18 can also save the model as a second output 62 as shown in FIG. 6. Second output 62 is, preferably, an object oriented output. Namely, each component (e.g., the cut line, the decorative pattern, etc.) of model 44 is saved as a related object in second output 62, and not as a unrelated pixel as in prior systems. Tool 18 can then be used to adjust the relation of each object in second output 62 to one another in order compensate for the second type of scaling error.

As discussed above, modification of cut line 22 in program 16 requires the cut line to be erased and redrawn as second cut line 42. Program 16 also required further processing to include additional decorative pattern 34 in the new areas of model 20. Advantageously, second output 62 of tool 18 eliminates these deficiencies.

Figure 9:
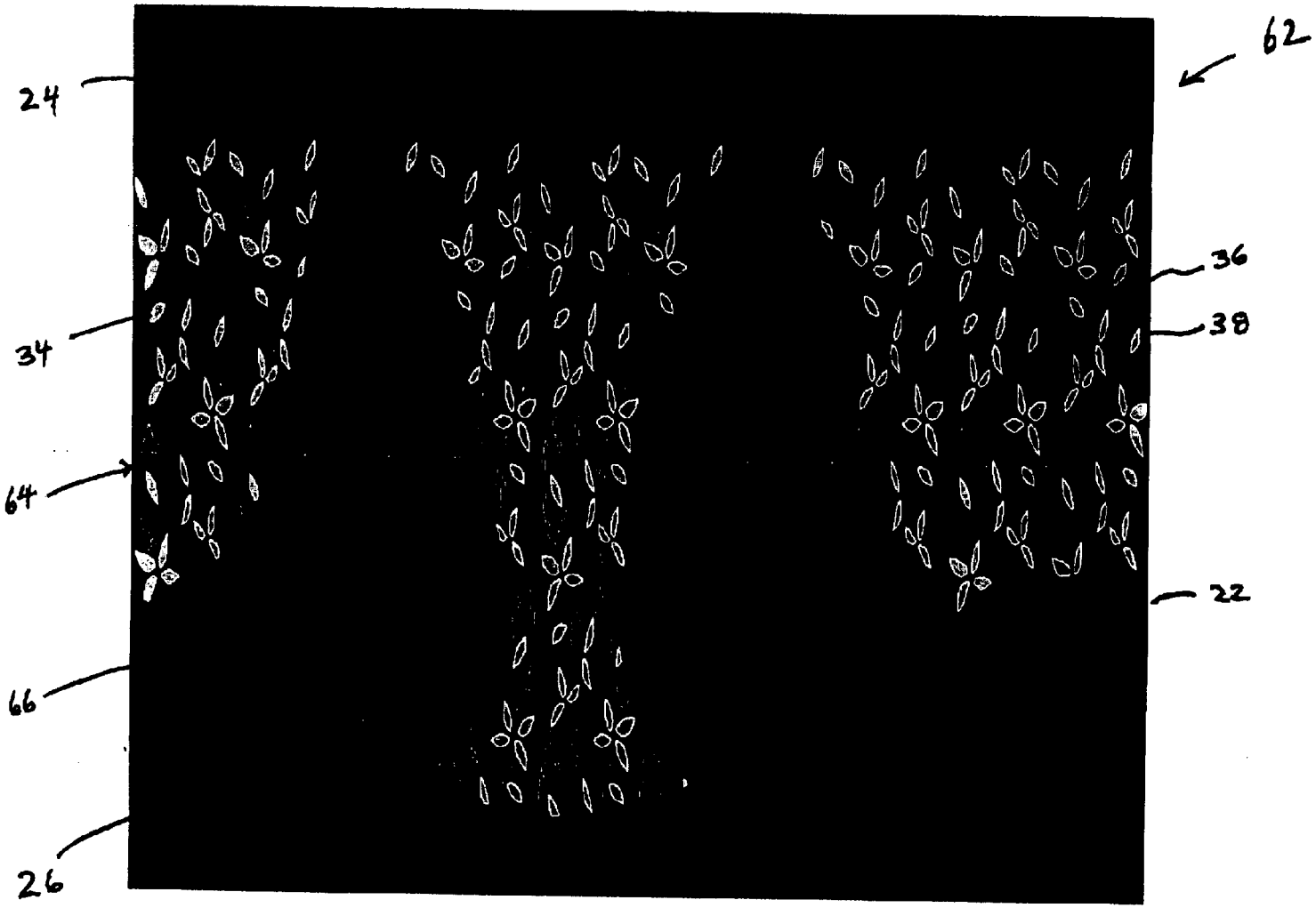
FIG. 9 illustrates a relationship among various objects of a second type of output from the design tool of FIG. 5.

An example of second output 62 in which cut line 22 and decorative pattern 34 are related objects is illustrated in FIG. 9. Decorative pattern 34 has a first portion 64 in garment region 24 and a second portion 66 (illustrated in phantom) in scrap region 26. Due to a user established relationship between cut line 22 and decorative pattern 34, second portion 66 is hidden. Second portion 66 is not incorporated when second output 62 is saved as first output 46. Thus, second portion 66 is not knitted into the resultant garment.

However, tool 18 allows the user to simply move the object representing cut line 22 to a new desired location. Here, cut line 22 is not erased and redrawn. Rather, tool 18 allows the user to move cut line 22 to a new desired location in second output 62. In addition, tool 18 allows the user to reshape cut line 22 in second output 62. Since decorative pattern 34 and cut line 22 are objects in second output 62, first portion 64 and second portion 66 of decorative pattern 34 are automatically adjusted due to the modification of the shape and/or position of cut line 22. Accordingly, further processing of decorative pattern 34 is not required as in prior systems. Rather, movement of the cut line 22 with respect to decorative pattern 34 reveals only portion 64 of decorative pattern 34 in garment region 24, while hiding portion 66 of decorative pattern 34 in scrap region 26.

Thus, tool 18 can be used to easily move and re-shape one or more of the components of second output 62, which can simplify and increase the speed of designing garments as compared to prior systems.

Accordingly, tool 18 allows for three-dimensional garment design. Tool 18 also allows the resultant garment model to be stretched to a desired size by a stretching function. The stretching function governs the strectching of the garment through the use of one or more user defined/selected rules, which can eliminate the first type of scaling error of prior systems. In addition, tool 18 allows for object oriented designing of garments, which can eliminate the second type of scaling error of prior systems. Since tool 18 provides the resultant output into the same bitmap file format that program 16 can convert, tool 18 can be used in conjunction with existing systems 10. Accordingly, tool 18 increases the speed and accuracy of the garment design process.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the present invention will include all embodiments falling within the scope of the appended claims.

What is claimed is:

1. A method of designing a circularly knitted garment, the method comprising:

designing a model of the circularly knitted garment;

stretching said model from a first size to a second size; and governing said stretching with one or more user definable rules, wherein said one or more user definable rules includes a first rule that limits a maximum number of a particular type of stitch in a selected direction.

2. The method as in claim 1, wherein said model is a three-dimensional model.

3. The method as in claim 1, further comprising saving said model as a first output, wherein said first output is a two-dimensional bitmap file.

4. The method as in claim 3, further comprising inputting said two-dimensional bitmap file into a program of a circular knitting system, said program converting said two-dimensional bitmap file into a machine code used to operate said circular knitting system.

5. The method as in claim 1, further comprising saving said model as a second output, said second output saving elements of said model as one or more related objects.

6. The method as in claim 5, further comprising adjusting a relationship between two or more related objects to form a second model.

7. The method as in claim 1, wherein said first rule replaces said particular type of stitch in excess of said maximum number with a desired stitch type.

8. A method of designing a circularly knitted garment, the method comprising:

designing a three-dimensional model of the circularly knitted garment;

saving said three-dimensional model as a first output and/or a second output, wherein said first output is a two-dimensional bitmap file and said second output relates elements thereof as related objects; and stretching said first output from a first size to a second size, and governing said stretching with one or more user definable rules, wherein said one or more user definable rules includes a first rule that limits a maximum number of a particular type of stitch in a selected direction.

9. The method as in claim 8, wherein said first rule replaces said particular type of stitch in excess of said maximum number with a desired stitch type.

10. The method as in claim 8, further comprising inputting said two-dimensional bitmap file into a program of a circular knitting system, said program converting said two-dimensional bitmap file into a machine code used to operate said circular knitting system.

11. The method as in claim 8, further comprising adjusting a relationship between said related objects to form a second model.

* * * * *